United States Patent [19]

Maina

[11] Patent Number: 4,972,796

[45] Date of Patent: Nov. 27, 1990

[54] DEVICE TO APPLY PARAFFIN OIL TO TEXTILE THREADS, PARTICULARLY WEFT THREADS IN SHUTTLELESS LOOMS

[75] Inventor: Bruno Maina, Valdengo, Italy

[73] Assignee: Roj Electrotex S.p.A., Biella, Italy

[21] Appl. No.: 348,026

[22] Filed: May 5, 1989

[30] Foreign Application Priority Data

May 5, 1988 [IT] Italy ..... 20461 A/88

[51] Int. Cl.[5] ..... B05C 11/105

[52] U.S. Cl. ..... 118/234; 118/268; 118/401; 222/187

[58] Field of Search ..... 118/268, 264, 234, 260, 118/401, DIG. 22; 57/295, 296; 222/187

[56] References Cited

U.S. PATENT DOCUMENTS

| | | | |
|---|---|---|---|
| 1,684,923 | 9/1928 | Mayer | 118/268 |
| 1,736,543 | 11/1929 | Mayer | 118/268 |
| 1,999,417 | 4/1935 | Lowe et al. | 118/268 |
| 2,678,024 | 5/1954 | Kresse | 118/268 |
| 3,162,544 | 12/1964 | Cobert | 118/DIG. 22 |
| 3,939,635 | 2/1976 | Rehn et al. | 57/296 |
| 4,394,844 | 7/1983 | Wood et al. | 118/268 |
| 4,573,314 | 3/1986 | Lorenz | 118/264 |
| 4,759,175 | 7/1988 | Inoue | 118/268 |

FOREIGN PATENT DOCUMENTS

| | | |
|---|---|---|
| 146041 | 12/1903 | Fed. Rep. of Germany . |
| 2803488 | 8/1979 | Fed. Rep. of Germany . |
| 3412039 | 10/1985 | Fed. Rep. of Germany . |
| 1243253 | 8/1960 | France . |
| 398191 | 9/1933 | United Kingdom . |

*Primary Examiner*—Jay H. Woo
*Assistant Examiner*—Khanh P. Nguyen
*Attorney, Agent, or Firm*—Young & Thompson

[57] ABSTRACT

Device to apply paraffin oil or like onto the surface of textile threads, so as to make them smoother and facilitate weaving thereof. The device includes: at least one container or vessel for a paraffin oil, closed by a cover; at least one rove or felt strip having at least one vertical length with the lower end plunged into the oil of the container and one length, usually horizontal, positioned beneath the cover of the container; and a distributing head, positioned beneath the cover of the container and above the path of the thread, and consisting of a filtering membrane, on the surface of which rests the rove, and of a member pressing the rove onto said membrane, the path of the thread being such that it laps from underneath the outer surface of said membrane.

7 Claims, 2 Drawing Sheets

FIG.1
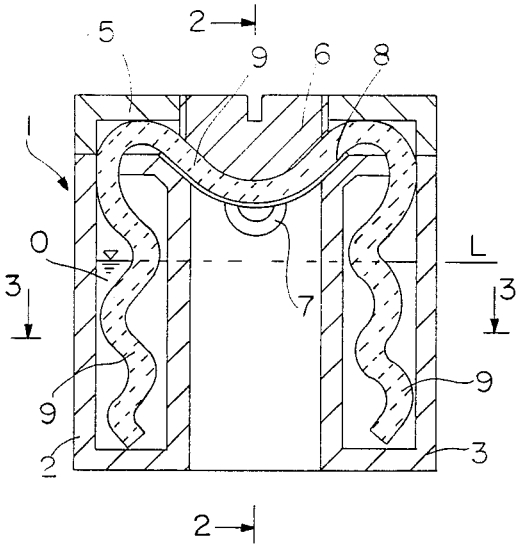
FIG.2
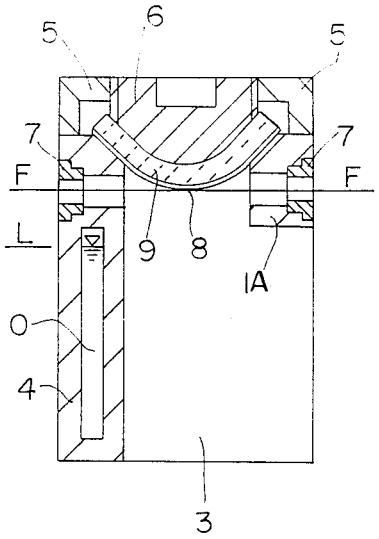
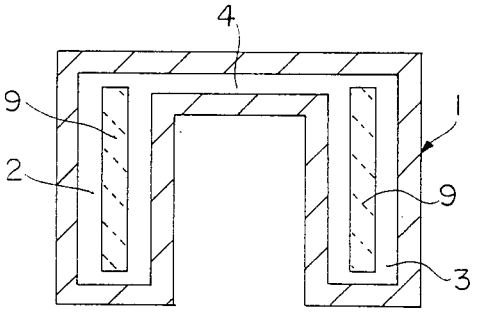
FIG.3

DEVICE TO APPLY PARAFFIN OIL TO TEXTILE THREADS, PARTICULARLY WEFT THREADS IN SHUTTLELESS LOOMS

BACKGROUND OF THE INVENTION

The present invention concerns a device to apply paraffin oil to textile threads (whether they be yarns obtained from tuft textile fibers, or continuous synthetic filaments) and it relates, in particular, to a device for applying paraffin oil to weft threads fed to textile machines, as weaving looms.

Applying paraffin oil to textile threads in a known and fairly widespread practice in spinning, which generally consists in causing the thread—before it is wound into cops or reels—to skim over a disk or block of paraffin wax. This operation increases the smoothness of the threads, reducing the friction factor.

In weaving, owing to the ever increasing speed of shuttleless looms which characterizes modern technique, it appears more and more helpful, and sometimes necessary, to treat weft threads with paraffin oil. Particularly in air jet looms, paraffin makes it easier for the thread to be blown across the warp shed and helps to keep it properly stretched out in the fluid stream, reducing the risk of loops or snarls.

In some cases, it is merely sufficient to eliminate the irregularities, deriving from previous treatments on the thread, by means of lubricants, antistatics or other chemical ingredients, which irregularities can either show up when passing from one cop or reel to the other, or even be present in the single cop or reels.

This type of inconvenience can occur quite frequently with acetate viscose rayon yarns: small residues of acetone left on the fiber may cause the lubricant applied on the thread to volatilize from the outer-most layers of the cop and from its ends. Hence, especially if the lubricant is light, i.e. of low molecular weight, there can be great differences in thread behaviour during weft insertion from a same cop, and thus serious difficulties of loom working.

In such cases, a valid remedy can be to apply small quantities of paraffin on the thread. It is a known practice to cause the thread, being unwound from the reel, to skim the surface of a wax block or disk—which may be fixed or even rotary—positioned between the reel and the weft feeder.

This system, though having the advantage of being remarkably simple, however involves different drawbacks. In fact, the spreading of paraffin over the thread, by causing this latter to skim the surface of a block or disk, rarely turns out to be uniform and satisfactory. Furthermore, the typical movement of the weft yarn—intermittent and with variable speed-easily produces on the wax block grooves and irregularities which, due to the same movement, may cause breaking of the yarn. There can be problems also in choosing the wax composition which is most suited to the type of yarn and of fiber being treated; and furthermore, the chemical-physical characteristics of the waxes may be inadequate for launching the yarn in air jet looms.

These difficulties may be largely overcome by using, instead of wax, liquid paraffin oils which allow the addition of emulsifying agents and/or antistatics and which help to make for important characteristics, as viscosity, by mixing different oils.

The devices for applying liquid paraffin, known up to date, consist of a container for the liquid and of a rove or felt strip of textile material which draws by capillarity the oil from the container and spreads it, through direct contact, over the external part of the moving thread.

Various drawbacks are however still present in devices of this type: for example, the difficulty in proportioning the oil and, thus, an uneven distribution of the oil over the thread; the risk that the thread might get caught on the hairy surface of the rove and thus break; and the fast wear of the rove, especially when working yarns or filaments of synthetic fibers.

SUMMARY OF THE INVENTION

All these drawbacks can be eliminated with the device to apply paraffin to textile threads, object of the present invention, which enjoys furthermore the advantages provided by applying liquid paraffin oils, so as to satisfy the requirements of fast modern looms.

Said device is characterized in that it comprises: at least one container or vessel for a paraffin oil, closed by a cover; at least one rove or felt strip having at least one vertical length with the lower end plunged into the oil of the container and one length, usually horizontal, positioned beneath the cover of the container; and a distributing head, positioned beneath the cover of the container and above the path of the thread, and consisting of a filtering membrane, on the surface of which rests the rove, and of a member pressing the rove onto said membrane, the path of the thread being such that it laps from underneath the outer surface of said membrane.

In said device, the paraffin oil into which is plunged the end of the vertical length of the rove rises through capillarity, up to soaking the horizontal length of said rove, and is distributed through the filtering membrane over the thread lapping this latter, without the rove—protected by the membrane—being stressed by the thread.

The filtering membrane will preferably consist of a wire gauze or of a sintered metal shell.

According to a preferred embodiment of the invention, the distributing head in the form of a filtering membrane has the shape of a bowl with downward facing convexity, and the rove is positioned substantially like an overturned U, with the two vertical lengths drawing oil from two communicating compartments of the container and a usually horizontal intermediate length mating with the inner surface of said bowl-shaped membrane, the cover of the container comprising a screw plug, which ends inside with a surface of a shape mating with that of said bowl-shaped membrane and which retains and presses with an adjustable intensity said intermediate length of the rove against the filtering membrane, so that the oil can flow in the right proportion over the thread through said membrane.

BRIEF DESCRIPTION OF THE DRAWINGS

The invention is now described in detail, with reference to a preferred embodiment thereof, illustrated on the accompanying drawings, in which:

FIG. 1 is a section view of the device according to the invention, perpendicular to the path of the thread being treated with paraffin oil;

FIG. 2 is a section view along the line 2-2 of FIG. 1, and thus perpendicular to the previous one, showing the thread;

FIG. 3. is a plan section view along the line 3-3 of FIG. 1, showing the device according to the invention.

DESCRIPTION OF THE PREFERRED EMBODIMENT

Figure 4:
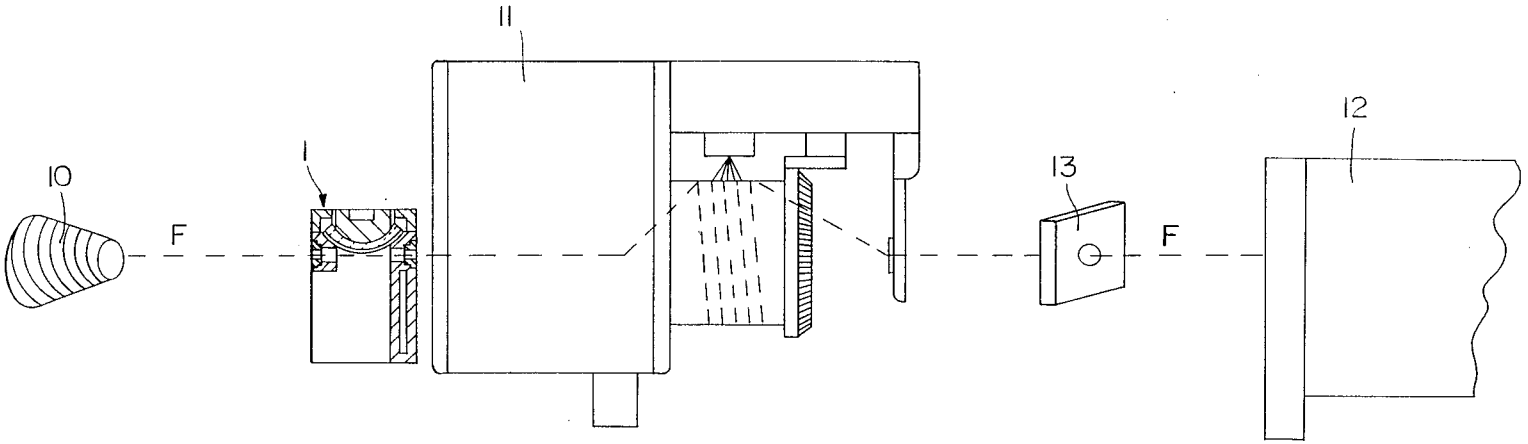
FIG. 4 is a diagram showing the positioning of the device of FIGS. 1 to 3, on the weft yarn feeding side of a shuttleless loom.

As shown in the drawings, the device to apply paraffin oil comprises a container 1 for the oil being distributed over the thread F, which is preferably U-shaped (plan view of FIG. 3) with two lateral compartments 2 and 3 connected together by a transverse compartment 4, so that the liquid O (paraffin oil or the like) may reach an equal level L in both said compartments 2 and 3. On the side opposite to the compartment 4, the walls of the compartments 2 and 3 are connected by an extension 1A (FIG. 2).

The container 1, made of semitransparent plastic material so as to be able to check the level L of the oil O, is open at the top, but is closed by a cover 5, fixed by screws (not shown in the drawings) and having at the center a screw plug 6. The cover 5 comprises two threadguide eyelets 7 formed, respectively, at the center of the compartment 4 and at the center of the extension 1A. A filtering membrane 8, in the form of a spherical bowl with downward facing convexity, is mounted between the cover 5 and the container 1 in an intermediate position between the eyelets 7 and over the path of the thread F between said eyelets. Said membrane may suitable consist of a wire gauze or of a sintered metal shell.

A strip of fabric of felt 9, forming a rove and bent like an overturned U, is plunged into the oil in each of the compartments 2 and 3 of the container 1 with the lower ends of its vertical lengths, while its intermediate length, usually horizontal, rests on the membrane 8, being retained and pressed against the same by the screw plug 6.

The inner end of the plug 6 is bowl-shaped like the membrane 8, and the plug can be screwed onto the cover 5 so as to compress with an adjustable pressure the rove 9 onto the membrane 8 and thus proprotion, in a very simple way, the oil flowing onto said filtering membrane 8. The assembly of the membrane 8, the rove 9 and the plug 6 housed in the cover 5, thus forms a head distributing the oil O—in an amount which can be regulated—over the thread F.

The thread F under tension, guided by the eyelets 7, positions itself along a path lapping from underneath the outer surface of the bowl of the distributing head 6, 8, 9. The thread F thus moves beneath the lowest surface of the filtering membrane 8, in close contact (ideally punctiform) therewith, just where the oil fed by the rove 9 accumulates due to gravity.

The filtering membrane 8—which can be made of sintered metal with a porous structure, or of thin punched plate, or it can be more simply a wire gauze—is adapted to guarantee a uniform flow of oil over the thread, to provide the thread with a smooth sliding surface, and to protect the rove 9 from wear.

The fact that the oil distributing head, formed as said, is positioned in the lower part of the cover 5 and is practically housed in the container 1—as can be seen from FIGS. 1 and 2—protects said head from dust and keeps it thoroughly clean, while the particular U-shape of the container 1 allows dust or any other impurities to freely drop from the thread F along its inner path between the two guide eyelets 7.

The device to apply paraffin oil according to the invention, though also applicable to textile workings other than weaving, is particularly designed to treat weft threads before their insertion into the shed of fast shuttle-less looms.

The positioning of the device, in this particular application, is shown in the diagram of FIG. 4, wherein reference 10 is the cop or reel of the thread F, reference 1 is the device to apply paraffin oil positioned downstream of the weft feeder 11 (of which it can be considered an accessory), reference 12 indicates the weaving machine or loom, and reference 13 is a yarn feeler positioned between the weft feeder and the loom 12.

Other embodiments of the heretofore described device to apply pariffin oil may of course be realized, without thereby departing from the scope of the present invention.

I claim:

1. In a device to spread oil onto the surface of a textile thread to be fed to a high speed shuttleless loom so as to facilitate weaving of the thread, comprising a container for oil, a cover closing the container, an inverted U-shaped wick having at least one vertical length having a lower end adapted to be immersed in oil in the container and a substantially horizontal length disposed beneath said cover of the container, and two thread guides formed on the container and defining a horizontal path for thread moving beneath the wick and receiving oil from the wick; the improvement comprising a downwardly convex filtering membrane having an upwardly concave upper surface on which the wick bears, and means pressing the wick onto said membrane, the thread having a path between said thread guides such that the thread continuously moves against a lower convex surface of said membrane.

2. A device as claimed in claim 1, said filtering membrane being bowl shaped.

3. A device as claimed in claim 1, in which said filtering membrane is wire gauze.

4. A device as claimed in claim 1, in which said filtering membrane is a sintered metal shell.

5. A device as claimed in claim 1, in which said wick has two vertical lengths each having a lower end adapted to be immersed in said oil.

6. A device as claimed in claim 1, said means pressing the wick onto said membrane comprising a screw plug which presses downwardly on the wick with adjustable force.

7. A device as claimed in claim 1, wherein said container has a U-shape as seen in plan.

* * * * *